United States Patent [19]

Ueyama et al.

[11] Patent Number: 4,762,432

[45] Date of Patent: Aug. 9, 1988

[54] METHOD OF THERMAL PRINTING

[75] Inventors: Seiji Ueyama, Hirakata; Hideo Taniguchi; Hiromi Ogata, both of Kyoto, all of Japan

[73] Assignees: General Company Limited, Osaka; Rohm Company Limited, Kyoto, both of Japan

[21] Appl. No.: 60,016

[22] Filed: Jun. 9, 1987

Related U.S. Application Data

[63] Continuation of Ser. No. 759,856, Jul. 29, 1985, abandoned.

[30] Foreign Application Priority Data

Mar. 15, 1985 [JP] Japan ..... 60-53068

[51] Int. Cl.[4] ..... B41J 31/00; B41M 5/26

[52] U.S. Cl. ..... 400/241.1; 400/120; 428/488.4

[58] Field of Search ..... 400/120, 237, 241.1, 400/696; 428/488.1, 488.4, 408; 346/76 PH

[56] References Cited

U.S. PATENT DOCUMENTS

| | | | |
|---|---|---|---|
| 3,037,879 | 6/1962 | Newman et al. | 400/241.1 |
| 3,596,055 | 7/1971 | Elston | 400/120 |
| 3,855,448 | 12/1974 | Hawagata et al. | 400/120 X |
| 4,103,066 | 7/1978 | Brooks et al. | 400/241.1 |
| 4,269,892 | 5/1981 | Shattuck et al. | 400/241.1 |
| 4,315,643 | 2/1982 | Tokunaga et al. | 400/241.1 |
| 4,384,797 | 5/1983 | Anderson et al. | 400/120 X |
| 4,459,055 | 7/1984 | Asakura et al. | 400/241.1 |
| 4,465,389 | 8/1984 | Knirsch et al. | 400/241.1 |
| 4,581,283 | 4/1986 | Tokunaga et al. | 400/241.1 X |
| 4,592,945 | 6/1986 | Mecke et al. | 400/241.1 |

OTHER PUBLICATIONS

"Erase-Proof Thermal Disks" IBM Technical Disclosure Bulletin, vol. 27, No. 4A, Sep. 1984 pp. 1909–1910.

*Primary Examiner*—Eugene H. Eickholt

*Attorney, Agent, or Firm*—Wegner & Bretschneider

[57] ABSTRACT

Thermal printing is effected by pressing a heat generating element of a thermal head to paper intervening a transferring ribbon with a heat-sensitive ink layer and immediately after printing, the transferring ribbon is bend so as to detach rapidly the ribbon from the paper.

3 Claims, 1 Drawing Sheet

METHOD OF THERMAL PRINTING

This application is a continuation of Ser. No. 759,856, filed July 29, 1985, and now abandoned.

BACKGROUND OF THE INVENTION

1. Field of the Invention

This invention relates to a method of thermal printing using a thermal print head.

2. Description of the Prior Art

In thermal printing methods, it is well known that a transferring ribbon is contacted with a paper and a thermal print head is pressed to the surface of the ribbon to effect printing. According to such prior art method, even after the printing is finished, the paper and the printing ribbon are sent still in a contacting state for a while.

Ink in ordinary transferring ribbons becomes a molten state when heated, and therefore, in case that smoothness of the surface of paper is low, the printed letters are blurred and the clearness is lowered. This is caused by many fine unevenness at the surface of the paper. That is, much ink flows into the recess portions and the raised portions protrude from the ink layer.

SUMMARY OF THE INVENTION

An object of the resent invention is to provids a printing method capable of producing clear print even when paper of low smoothness is used.

According to the present invention, there is provided a method of thermal printing comprising pressing a heat generating element of a thermal print head constituted of a head main body and the heat generating element set on the surface and in the vicinity of the end portion which becomes a rear end upon driving, of the head main body, to a receiving paper with an intermediate of a transferring ribbon having an ink layer comprising a thermoplastic resin which becomes cohesive by heating, to effect printing, and bending the transferring ribbon so as to detach rapidly the transferring ribbon from the receiving paper immediately after printing the receiving paper by the heat generating element.

DESCRIPTION OF THE PREFERRED EMBODIMENTS

Figure 1:
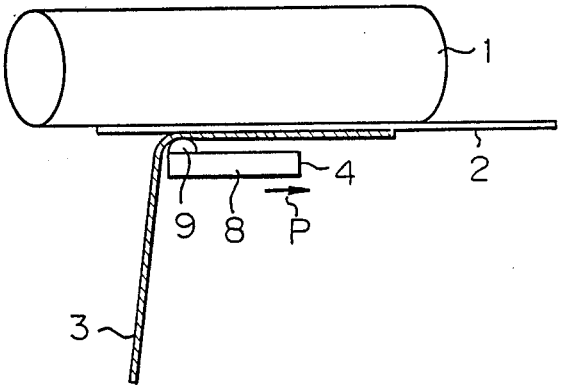
FIG. 1 schematically shows an embodiment of method according to the present invention.
Figure 2:
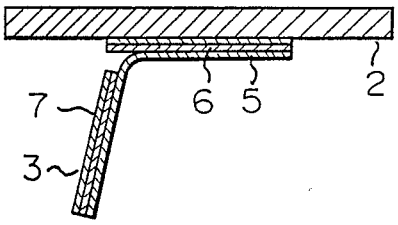
FIG. 2 is an enlarged cross sectional view of a part of FIG. 1.

Referring to FIG. 1 and FIG. 2, 1 is platen, 2 paper, 3 a transferring ribbon and 4 a thermal print head (hereinafter referred to as "head").

As shown in FIG. 2 transferring ribbon 3 is constituted of a base 5 composed of a film such as polyester, a releasing agent 6 (e.g. paraffin wax) overlying base 5 and capable of being released from base 5 by heat, and an ink layer 7 overlying the releasing layer.

Ink layer 7 is mainly composed of a thermoplastic resin, that is, ink layer 7 is made by mixing a thermoplastic resin, a binder, a coloring agent, a pigment and the like. The thermoplastic resin becomes cohesive when heated.

Releasing agent 6 is not always necessary, but releasing agent 6 serves to release easily the ink layer from the base resulting in decrease in the energy necessary for printing.

A transferring ribbon suitable for the method of the present invention can be produced, for example, by the following procedure.

To a polyester film of 6μ thick is applied paraffin wax in the thickness of 1μ by a hot melt coating method to form a heat-sensitive releasing layer, and then a coating composition composed of the following ingredients:

| | |
|---|---|
| Ethylene-vinyl acetate (90:10) copolymer | 70 parts by weight |
| Carnauba wax | 10 parts by weight |
| Carbon black | 20 parts by weight |
| Ethyl acetate | 100 parts by weight |
| Toluene | 200 parts by weight |

is applied to the heat-sensitive releasing layer by Mayer bar method and dried to produce a heat-sensitive transferring ink layer of 4μ thick.

A head 4 is mainly constituted of a head main body 8 and a heat generating element 9. Heat generating element 9 is positioned at one end of head main body 8. This one end is the rear end when head main body 8 is driven.

Printing is carried out by driving the head 4 to the direction of the arrow P and pushing the head 4 to paper 2 with transferring ribbon 3 as an intermediate. Immediately after printing, that is, immediately after transferring ribbon 3 passes heat generating element 9 of head 4, transferring ribbon 3 is rapidly detached from paper 2.

Pressing transferring ribbon 3 to paper 2 is the same as that in prior art, but when ink layer 7 of transferring ribbon 3 is heated by heat generating element 9, the heated portion is not melted, but becomes cohesive. This cohesive portion is pressed to paper 2, and, even if there is fine unevenness on the surface of paper, such cohesivity of ink enables to attach the ink to paper 2 along the uneven surface. Thus, the ink layer can attach to paper without interruption even if the surface of the paper is not smooth. On the other hand, immediately after the heated portion of ink layer 7 attaches to paper 2 as mentioned above, transferring ribbon 3 is rapidly detached from paper 2, for example, in such a manner that the ribbon 3 is bent. By this bending, ink layer 7 is cut at the boundary of the heated portion and the non-heated portion of ink layer 7, and these two portions are surely separated at the boundary. Since heat generating element 9 is set in the vicinity of the rear end of head main body 8, even immediately after printing, transferring ribbon 3 can be bent.

As the result of the present inventors' experiment, it has been ascertained that when the bending angle of transferring ribbon 3 (the angle between transferring ribbon 3 after printing and paper 2) is less than 70 degrees, clearness of print images does not vary so much depending on decrease or increase in the angle, but when the bending angle exceeds 70 degrees, the clearness increases rapidly.

As mentioned above, according to the present invention, a transferring ribbon provided with an ink layer which becomes cohesive when heated is used, and immediately after heat-printing by means of a thermal print head, the transferring ribbon is rapidly detached from the receiving paper by bending the transferring ribbon. As a result, clear printed images can be advantageously produced on a paper of low smoothness.

What is claimed is:

1. A method of thermal printing comprising:

placing an ink transferring medium between an ink receiving medium and a thermal printing head, said thermal printing head having a heating element, contacting the heating element against the ink transferring medium to effect printing on the ink receiving medium, and rapidly separating the ink transferring medium from the ink receiving medium immediately after printing, wherein the ink transferring medium includes an ink layer which becomes cohesive when heated, said ink layer comprising:

| | |
|---|---|
| ethylene-vinyl acetate (90:10) copolymer | about 70 parts by weight |
| carnauba wax | about 10 parts by weight |
| carbon black | about 20 parts by weight. |

2. The method of claim 1 wherein the ink transferring medium further includes a heat-sensitive releasing layer for facilitating transfer of the ink layer to the ink receiving medium.

3. The method of claim 1, wherein the angle of separation between said ink transferring medium and said ink receiving medium is at least 70°.

* * * * *